United States Patent [19]

Bierenfeld et al.

[11] 4,066,317

[45] Jan. 3, 1978

[54] ELECTRICAL CONDUCTOR TERMINATING SYSTEM

[75] Inventors: Herbert H. Bierenfeld, Doraville; Charles McGonigal, Grayson, both of Ga.; Chauncey M. Horton, Jr.; John A. Kelsey, both of North Andover, Mass.

[73] Assignee: Western Electric Company, Inc., New York, N.Y.

[21] Appl. No.: 728,337

[22] Filed: Sept. 30, 1976

[51] Int. Cl.[2] ..... H01R 9/08

[52] U.S. Cl. ..... 339/91 R; 339/98

[58] Field of Search ..... 339/97 R, 97 P, 98, 339/99 R, 91 R, 198 R, 198 G, 198 GA, 198 H

[56] References Cited

U.S. PATENT DOCUMENTS

| | | | |
|---|---|---|---|
| 3,611,264 | 10/1971 | Ellis, Jr. | 339/99 R |
| 3,860,318 | 1/1975 | Reavis, Jr. et al. | 339/99 R |

*Primary Examiner*—Roy Lake
*Assistant Examiner*—Neil Abrams
*Attorney, Agent, or Firm*—D. D. Bosben

[57] ABSTRACT

A terminal strip assembly of an electrical conductor terminating system includes a first insulating terminal support block having an essentially M-shaped configuration, with a transverse bight portion, rows of electrical conductor guide portions projecting in a first direction from the same side of the bight portion, and resilient side legs projecting in a reverse direction from locations adjacent an opposite side of the bight portion. A row of U-shaped terminals is mounted on the first support block and each terminal includes bifurcated legs which extend within respective adjacent ones of the guide portions to receive electrical conductors inserted between the guide portions. A connector plug assembly for use with the terminal strip assembly includes a second insulating terminal support block having a row of essentially J-shaped electrical conductor terminals mounted thereon. One leg of each of these terminals extends within a pair of respective adjacent electrical conductor guide portions of the second support block. A second leg of each of the J-shaped terminals projects into a channel in the second support block so that the second leg is received in a respective one of the bifurcated terminal legs of the U-shaped terminals in the first support block when the connector plug assembly is plugged onto the terminal strip assembly. Releasably mounted members on the terminal support blocks retain the U-shaped terminals and the J-shaped terminals on the support blocks.

23 Claims, 26 Drawing Figures

ELECTRICAL CONDUCTOR TERMINATING SYSTEM

BACKGROUND OF THE INVENTION

1. Field of the Invention

This invention relates to an electrical conductor terminating system, and more particularly to an electrical conductor terminating system in which electrical apparatus can be installed in the field utilizing either bulk cable on a single or paired-wire quick-connect basis, or connectorized cable on a multiwire plug-in basis, or various combinations of these two wiring methods.

2. Description of the Prior Art

It is standard practice in the installation of certain types of electrical apparatus in the field, such as telecommunications transmission equipment bays in a telephone central office, to interconnect the equipment bays to one another by suitable cabling. This interconnection has been accomplished in a variety of ways, including the use of (1) formed cable, in which interbay cables are preformed in the factory or manufacturing location and then subsequently connected directly to equipment terminals in the field by an installer; (2) bulk cable, in which interbay cables are formed from a bulk cable supply in the field and connected directly to equipment terminals by the installer; (3) connectorized cable, in which equipment local cables are wired to the equipment terminals and provided with connector plugs in the factory, and in which interbay cables also are formed with connector plugs in the factory, with the local cables and the interbay cables subsequently being merely plugged together in the field; and (4) terminal strips having, for example, solderless-wrap or quick-connect terminals, in which the equipment is wired to the terminal strips in the factory, and interbay cables subsequently are formed from a bulk cable supply in the field (as noted hereinabove in method #2) and connected to the terminal strips.

Of the foregoing wiring systems, formed cable (method #1) and bulk cable (method #2) generally are lowest in cost, but require longer installation intervals and extensive activities adjacent to working equipment in the field. These field-wired systems also generally result in lower quality as compared to the factory-wired cables involved in the use of connectorized cables or terminal strips. As between connectorized cable and terminal strips, connectorized cable generally is advantageous because of the short installation interval involved, with the least disruption to existing equipment and services, and because it usually results in the highest overall quality system at the lowest cost. Connectorized cable is also desirable because it facilitates maintenance and relocation or reassociation of equipment. Accordingly, in recent years the use of connectorized cable in the installation of transmission equipment, as well as other types of electrical equipment, has significantly increased. In certain instances, however, connectorized cable is not always practical, as for example where a complex network of transmission equipment bays is to be interconnected. Rather, it then may be preferable to interconnect the equipment bays utilizing bulk cable in association with terminal strips, or to utilize connectorized cable, bulk cable and terminal strips in various combinations with one another.

Heretofore, however, connector plugs for connectorized cable have been designed for use primarily with another mating connector plug, while terminal strips have not been designed for use in combination with connectorized cable. For example, in a connector plug arrangement disclosed in U.S. Pat. No. 3,760,335, issued Sept. 18, 1973 to L. E. Roberts, the wires of two cables which are to be interconnected are secured to quick-connect solderless terminals of respective mating connector housings each having a standard number (e.g., 50) of terminals. After the wires have been connected to the terminals, shields or covers are slid onto the housings over the terminals and the wire portions therein, and the covers and housings are secured together by suitable screws to produce two mating connector plugs. To connect the cables together, the mating connector plugs are then plugged into one another during installation of the equipment in the field. When it is desired to remove, replace or rearrange the connected wires, the covers are disassembled from the housings, and then reassembled thereto when the desired changes have been completed.

Similarly, an example of a known type of terminal strip is disclosed in the U.S. Pat. No. 3,798,587, issued on Mar. 19, 1974 to B. C. Ellis, Jr. et al. . In this patent, one set of wires, such as the wires connected to the terminals of the equipment, are dressed along an elongated insulating block into respective spaced slots in the block. A second elongated insulating block has a row of elongated electrical terminals fixedly mounted therein, with the terminals having quick-connect bifurcated legs at their opposite ends. In use, the bifurcated legs at first ends of the terminals, which project outward from the second insulating block, are connected to the dressed wires in the first insulating block by assembling the two blocks together so that the bifurcated terminal legs receive respective ones of the dressed wires therebetween as the legs are inserted into slots in the first block. A second set of wires, as for example of an interbay cable, then are inserted into respective ones of the bifurcated legs at the other ends of the terminals to establish connections between the two sets of wires. A terminal strip of this same type is also shown in U.S. Pat. No. 3,496,522, issued to B. C. Ellis, Jr. et. al. on Feb. 17, 1970, and U.S. Pat. No. 3,611,264, issued to B. C. Ellis, Jr. on Oct. 5, 1971.

The U.S. Pat. No. 3,878,603, issued to L. A. Jensen on Apr. 22, 1975, discloses a solderless cable splicing device of a type similar to the terminal strip in the above-mentioned U.S. Pat. No. 3,798,587, in which two sets of cable wires to be spliced initially are dressed along an elongated first electrically insulating block and fanned into respective slots between longitudinally spaced wire guide portions on opposite sides of the block. An elongated electrically insulating second block, having a plurality of U-shaped terminals mounted thereon with quick-connect bifurcated legs projecting from the block, then is assembled to the first block with the legs of the terminals receiving respective ones of the fanned wires to complete the splice.

Thus a need exists for a versatile electrical conductor terminating system in which a terminal strip assembly is capable of universal use with various types of cable, such as, bulk formed cable on a quick-connect basis and connectorized cable on a plug-in basis, or various combinations thereof, and the purpose of this invention is to provide such a system which is inexpensive, reliable, capable of accomodating high termination densities, easy to repair and maintain, and readily adaptable to circuit design changes.

SUMMARY OF THE INVENTION

In general, this invention relates to an electrical conductor terminating system which comprises an electrically insulating support block for holding a plurality of electrical terminals. The terminal support block includes a body portion and spaced electrical conductor guide portions projecting from one side of the body portion in a first direction. First spaced insulating ribs in the guide portions define slots for receiving legs of the terminals, and second spaced insulating ribs on the body portion define slots for receiving bight portions of the terminals. Spaced resilient legs each project outward with respect to the body portion in a different direction than the first direction, and at least one of the legs has connecting means adjacent an outer free end thereof for assembling the support block to a member for retaining the terminals in the support block.

More specifically, a terminal strip assembly includes a first insulating support block having an essentially M-shaped configuration, with a bight portion, rows of electrical conductor guide portions projecting in a first direction from one side of the bight portion, and resilient side legs projecting in a reverse direction outward with respect to the bight portion. A row of U-shaped terminals is mounted on the first support block in slots defined by insulating ribs of the support block and each terminal includes legs which extend within respective adjacent ones of the guide portions. Each of the terminal legs is bifurcated to receive an electrical conductor inserted between its respective guide portions. A connector plug for use with the terminal strip assembly includes a second insulating support block having a row of essentially J-shaped electrical conductor terminals mounted thereon. One leg of each of these terminals extends within a pair of respective adjacent electrical conductor guide portions of the second support block. A second leg of each of the J-shaped terminals projects into a channel in the second support block so that the second leg is received in a respective one of the terminal legs of the U-shaped terminals in the first support block when the connector plug is assembled with the terminal strip assembly. Releasably mounted retaining members on the support blocks retain the U-shaped terminals and the J-shaped terminals on the support blocks.

DETAILED DESCRIPTION

Figure 14:
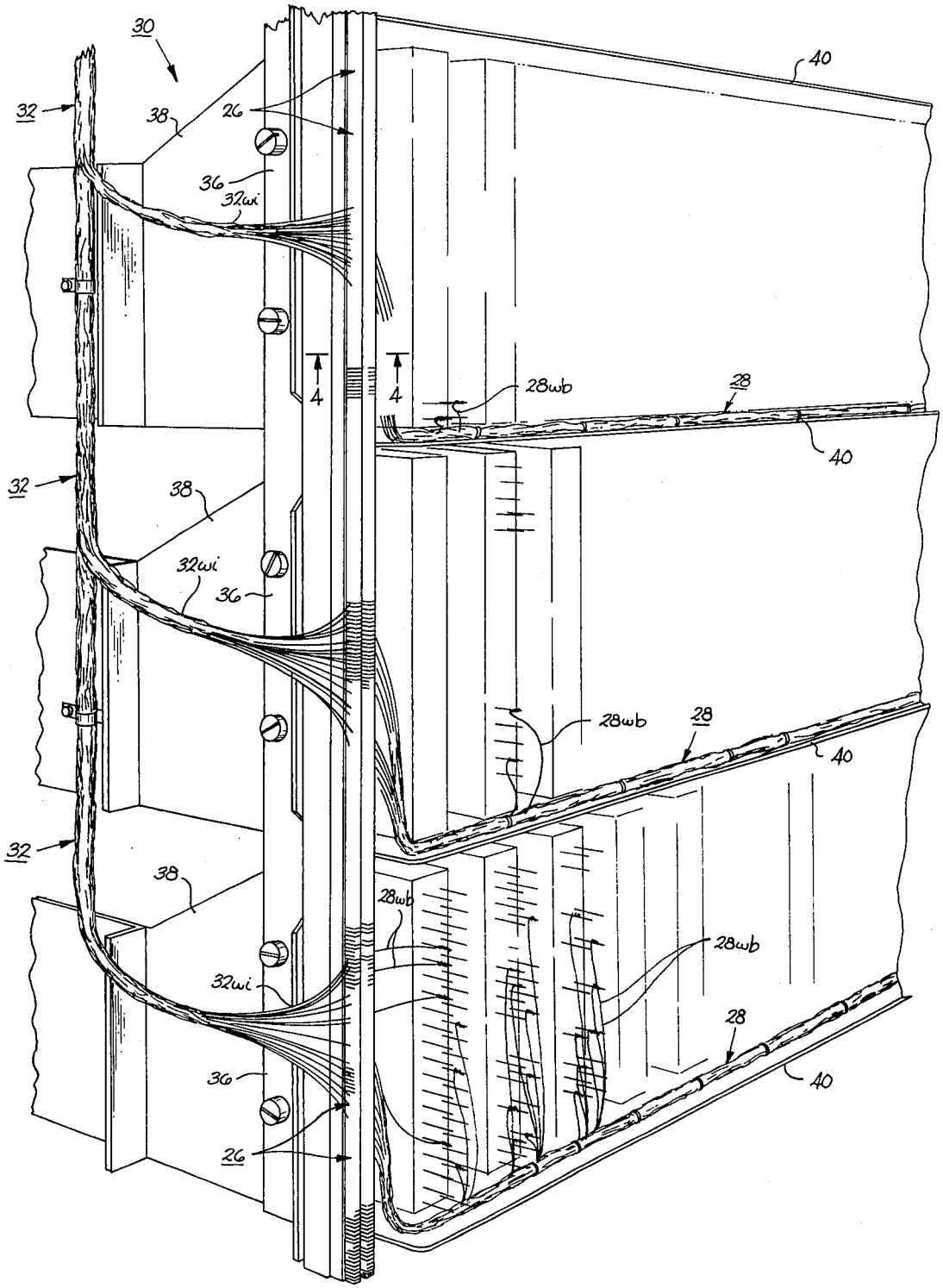
FIG. 14 is a partial isometric view of a communications equipment bay, illustrating one manner in which a plurality of the terminal strip assemblies shown in FIGS. 1 through 8 may be utilized.
Figure 15:
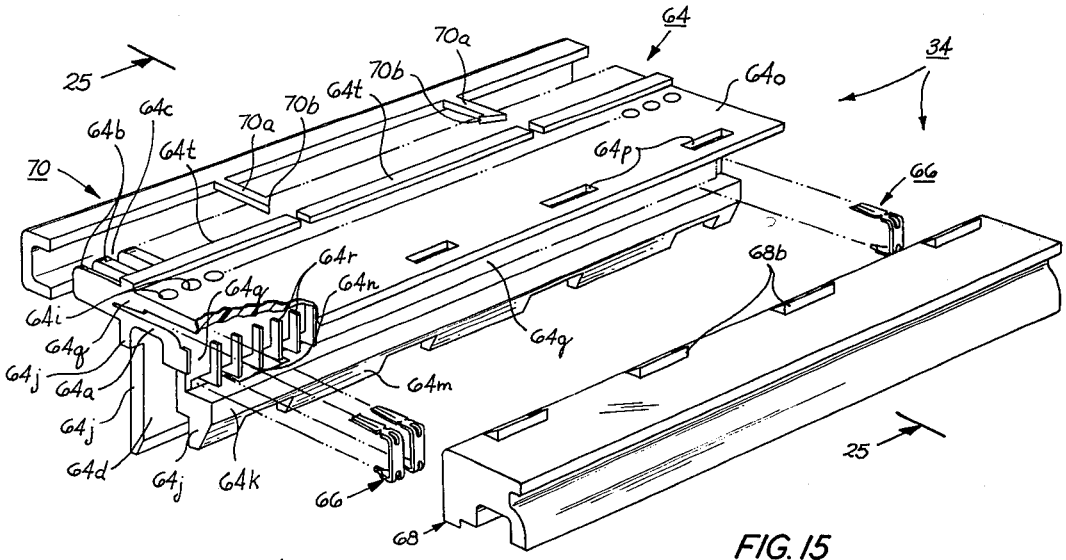
FIG. 15 is an isometric exploded view of a terminal connector plug assembly in accordance with the invention.
Figure 16:
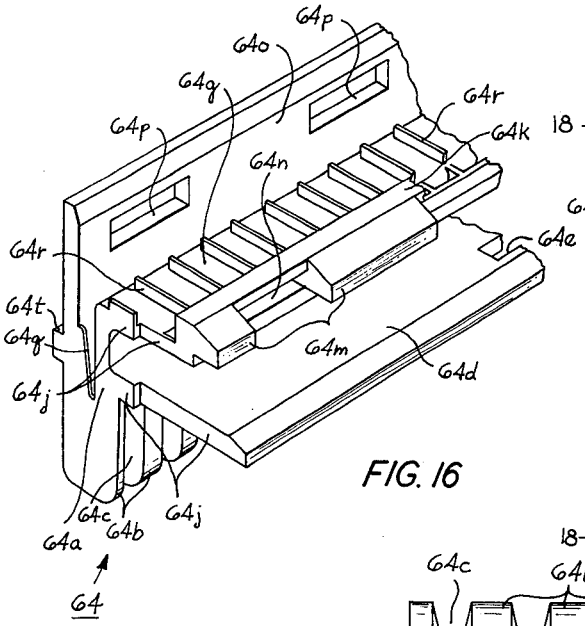
FIG. 16 is an isometric view of a terminal support block of the connector plug assembly shown in FIG. 15.
Figure 17:
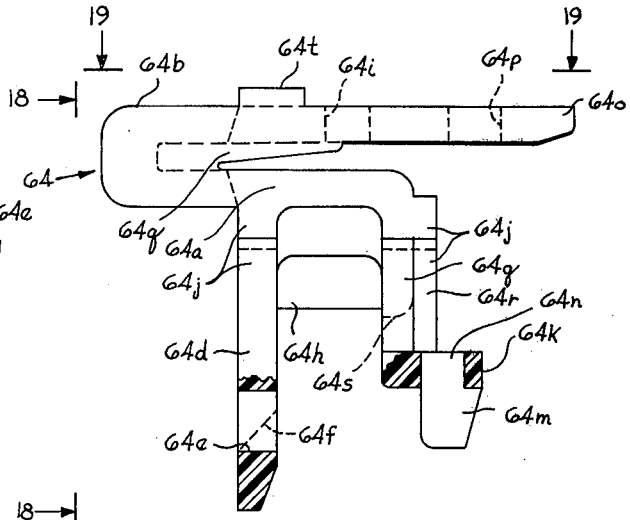
FIG. 17 is an end view, partially in cross section, of the terminal support block shown in FIGS. 15 and 16.
Figure 19:
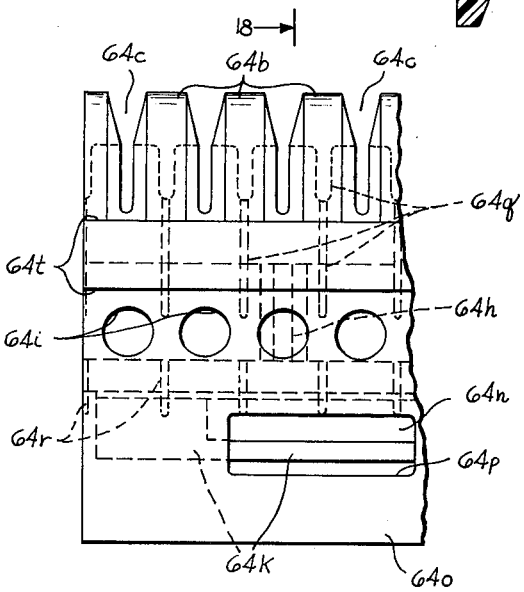
FIG. 19 is a view of the terminal support block shown in FIGS. 15–17, as viewed in the direction of the arrows 19—19 in FIG. 17.
Figure 18:
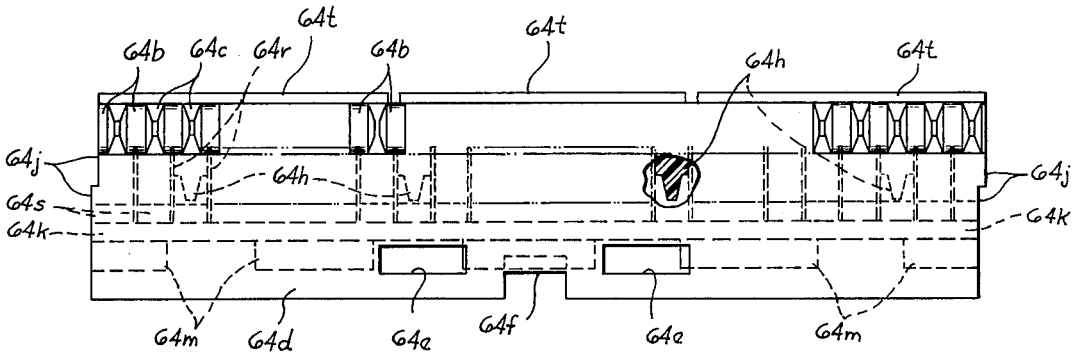
FIG. 18 is a view of the terminal support block shown in FIGS. 15–17, as seen in the direction of the arrows 18–18 in FIG. 17.

Referring to FIG. 14, the disclosed embodiment of the invention is directed to an electrical conductor terminating system in which terminal strip assemblies 26 (shown in detail in FIGS. 1 through 8) are utilized for the interconnecting of sets of insulated electrical conductor wires, such as sets of insulated electrical conductor wires **28*wb* of one or more local equipment cables 28 in a communications equipment bay 30, and sets of insulated electrical conductor wires 32*wi* of one or more interbay cables 32 for connecting the equipment bay to other equipment bays (not shown). The construction of each of the terminal strip assemblies 26 is such that the interbay cables 32 may be of a bulk cable type, with each of its wires 32***wi* connected individually or in pairs directly to the terminal strip assemblies on a quick-connect basis in the field as shown in FIG. 4. In the alternative, the interbay cable(s) may be a connectorized-type cable 32' (FIG. 25) which is preformed in the factory with a repeatable-type connector plug assembly 34 and then merely plugged into the terminal strip assembly 26 in the field as shown in FIG. 25.

In this connection, this invention is related to priorly conceived subject matter disclosed in the copending application of A. R. Goodrich et al., Ser. No. 728,340, filed concurrently herewith and assigned to the same assignee, and also entitled "Electrical Conductor Terminating System." In that application, a terminal strip assembly comprises an electrically insulating terminal support block and a row of U-shaped electrical terminals mounted within the support block. The terminals have quick-connect bifurcated legs disposed between wire guide portions of the support block for the reception of respective wires inserted between the guide portions. An electrically insulating base member is connected to the support block to retain the terminals in the support block. A wire carrier-and-seating device of special construction, which retains end portions of the cable wires in proper spatial relationship for insertion of the wire end portions into their respective terminal legs in the terminal strip assembly, simultaneously, or which can be provided with terminals for use as a repeatable-type connector plug, is utilized where it is desired to prefabricate (i.e., connectorize) the cable at the manufacturing location.

Figure 25:
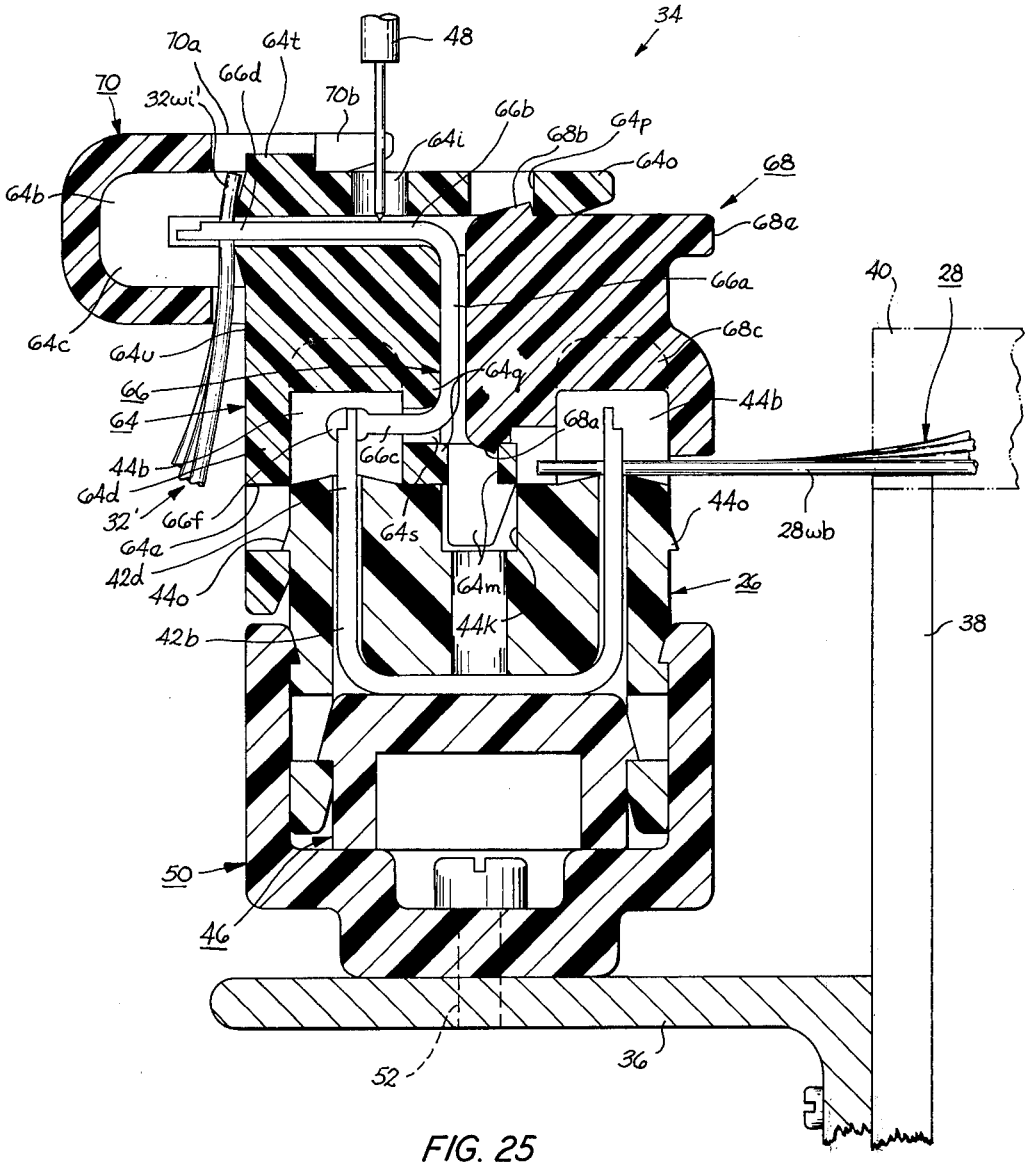
FIG. 25 is a cross-sectional view of the terminal strip assembly shown in FIGS. 1 through 8 and the connector plug assembly shown in FIGS. 15 through 24 in assembled relationship, as viewed generally along a line as indicated by the arrows 25—25 in FIG. 15.

In the disclosed embodiment of the invention, the terminal strip assemblies 26 are mounted on the frame of the equipment bay 30 by means of a series of vertically extending angle-bar mounting members 36, secured to standard frame mounting arms 38 in a manner best shown in FIGS. 4, 14 and 25, during manufacture of the bay in the factory. At the same time, the equipment bay wiring (e.g., the local cables 28) is formed by connecting first stripped ends of the insulated electrical conductor wires 28*wb* to terminals of the equipment bay (e.g., by solderless wire-wrapping), and connecting second unstripped opposite ends of the wires 28*wb* to respective ones of the terminal strip assemblies 26 on a quick-connect basis, as shown in FIGS. 4 and 25. The cables 28 may rest or be suspended upon horizontally projecting shelves 40 (FIG. 14) integrally connected at their opposite ends to respective ones of the frame mounting arms 38, such as by casting or welding, if so desired. In the alternative, the terminal strip assemblies 26 may be mounted in horizontal rows across the equipment bay 30 on the shelves 40, as shown in the above-mentioned copending application of A. R. Goodrich et al., or the terminal strip assemblies may be mounted in both horizontal and vertical rows in the equipment bay, in order to achieve greater terminal connecting capacity, as desired.

As noted hereinabove, the insulated electrical conductor wires 32*wi* of each of the interbay cables 32 also may be wired to the terminal strip assemblies 26 on a quick-connect basis in the field, as shown in FIG. 4. In the alternative, the interbay cable may be the connectorized type cable 32' shown in FIG. 25, in which insulated electrical conductor wires 32*wi'* of the cable are prewired to the connector plug assembly 34 (FIGS. 15–24) in the factory on a quick-connect basis, with the connector plug assembly subsequently being merely plugged into one of the terminal strip assemblies 26 in the field.

Figure 1:
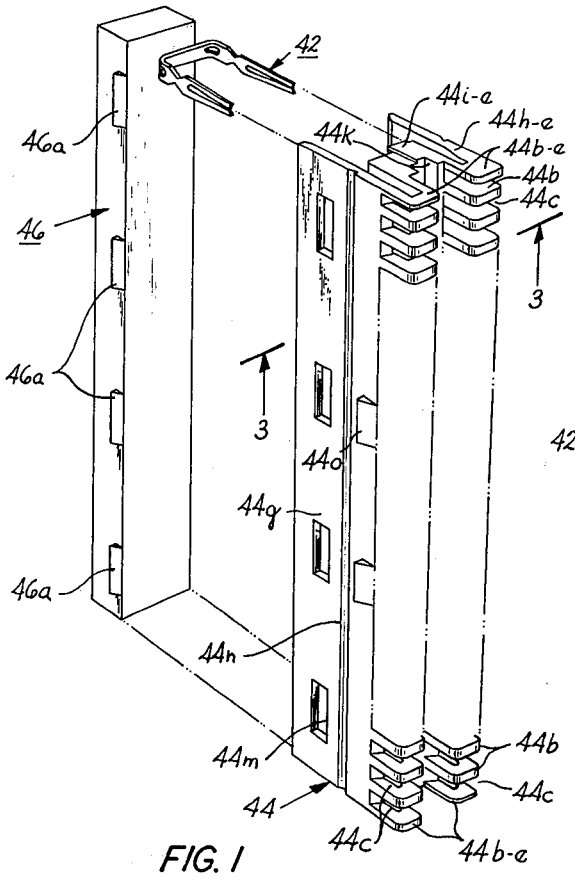
FIG. 1 is an isometric exploded view of a terminal strip assembly in accordance with this invention.

Referring to FIG. 1, the terminal strip assembly 26 includes a row of U-shaped electrical terminals 42, an elongated terminal support block 44 and a terminal retaining base member 46. The terminal support block 44 and the terminal retaining member 46 both are formed of a suitable electrically insulating material, such as molded plastic, as for example that sold by General Electric Plastics Business Division of Selkirk, New York under the tradename "Noryl 225."

Figure 2:
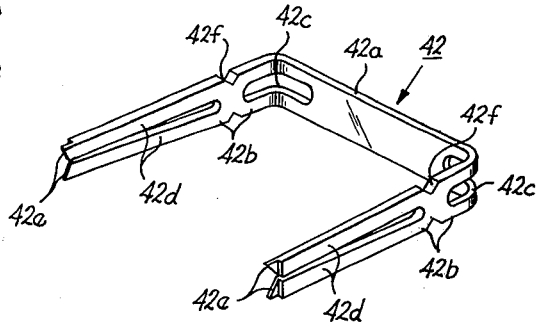
FIG. 2 is an isometric view of a terminal used in the terminal strip assembly of FIG. 1.

As is shown in FIG. 2, each of the terminals 42 is of a quick-connect type having a bight or body portion 42*a* and first and second legs 42*b* projecting from opposite sides of the bight portion. The terminals 42 are formed from an electrically-conducting resilient material, such as phosphorous deoxidized tin bronze, in a series of blanking, coining and bending steps, as for example in a progressive punch and die. In this forming operation, the material for each terminal 42 is formed, while in a flat state, with a pair of elongated apertures 42*c* adjacent respective opposite ends of the bight portion 42*a*, to facilitate subsequent bending of the terminal into the U-shaped configuration shown. Each of the legs 42*b* of the terminal 42 also is bifurcated to produce resilient furcations 42*d* having opposed essentially flat edges, and is formed, by blanking and coining, with relatively thin inwardly converging insulation cutting edges 42*e* adjacent its outer end. The thin outer insulation cutting edges 42*e* cause initial cutting through the insulation on a respective one of the insulated electrical conductor wires 28*wb* or 32*wi* to establish contact with the wire as it is pressed between the cutting edges, after which the insulation is displaced longitudinally of the wire as it passes between the opposed flat edges of the furcations 42*d*, in a manner disclosed in the U.S. Pat. No. 3,798,587. The spacing between the flat-faced furcations 42*d* is selected so as to be slightly less than the minimum diameter (e.g., 26 gage) of one of the electrical conductor wires 28*wb* or 32*wi* to be utilized, so that a plurality of wire diameters (e.g., from 22 gage to 26 gage) can be accommodated by the terminal. This ability of the furcations 42*d* to receive wires 28*wb* or 32*wi* of various diameters, without severing the wires, is achieved as a result of the opposed edges of the furcations being flat, and by forming notches 42*f* in the outer edges of the terminal legs 42*b* to facilitate flexing of the furcations as the wire is inserted therebetween.

Figure 3:
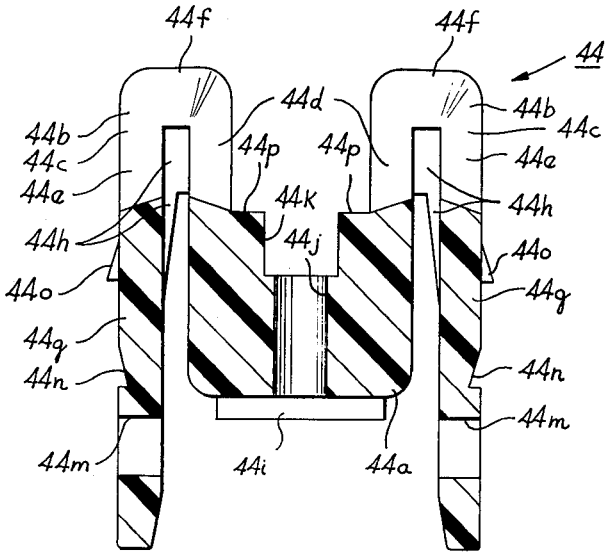
FIG. 3 is a cross-sectional view taken along the line 3—3 in FIG. 1.
Figure 4:
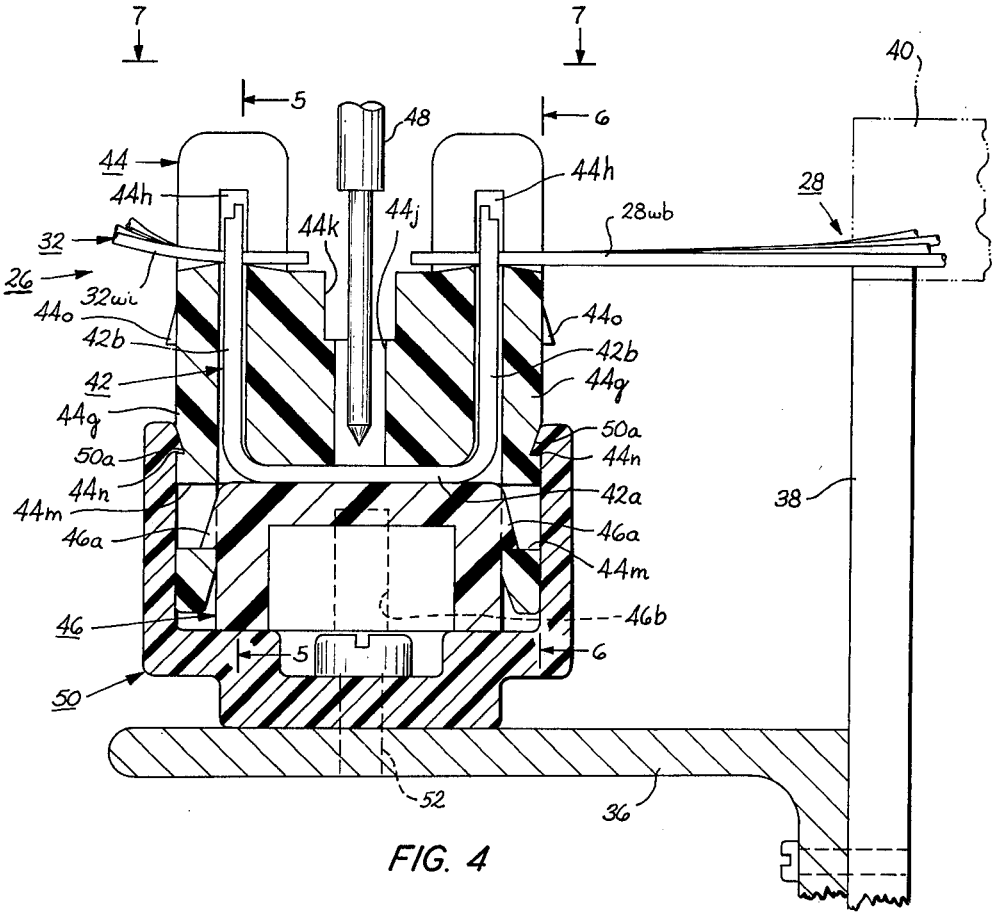
FIG. 4 is a cross-sectional view of the terminal strip assembly of FIG. 1 is assembled relationship, as viewed along the line 3—3 in FIG. 1.

As viewed in FIG. 3, in the disclosed embodiment of the invention the terminal support block 44 has an essentially M-shaped configuration and includes a transversely extending bight or body portion 44*a*. First and second spaced parallel opposed rows or sets of insulated electrical conductor wire guide portions 44*b*, which are spaced longitudinally (FIGS. 1, 5, 6 and 7) to define wire-receiving slots 44*c* therebetween, have first inner sections 44*d* integrally connected at first lower ends to the bight portion 44*a* and projecting upward in a first direction from an upper side of the bight portion. Second outer sections 44*e* of the wire guide portions are integrally joined at their upper ends with second upper ends of the inner sections 44*d* by generally arcuate third outer end sections 44*f*, and are integrally joined at their lower ends with resilient side walls or legs 44*g*. The outer wire guide sections 44*e* and the resilient side legs 44*g*, which form extensions of the outer sections, are spaced from the inner wire guide sections 44*d* and the bight portion 44*a*, respectively, for the reception of the legs 42*b* of the terminals 42 therebetween, as shown in FIG. 4. The resilient side legs 44*g*, which have outer free ends, also extend in a reverse direction downward (as viewed in FIGS. 3 and 4) below or outward with respect to the bight portion 44*a* adjacent its lower side in spaced parallel opposed relationship to permit the terminals 42 to be inserted into and removed from the support block 44, and for the reception of the terminal retaining base member 46 between the legs, as shown in FIG. 4. Preferably, the width of the wire-receiving slots 44*c* is slightly less than the diameter of the insulation on the insulated wires 28*wb* or 32*wi* so that the wire guide portions 44*b* grip the insulation to produce an inherent strain relief which prevents the wires from pulling out of the slots when the wires are mounted therein.

Figure 5:
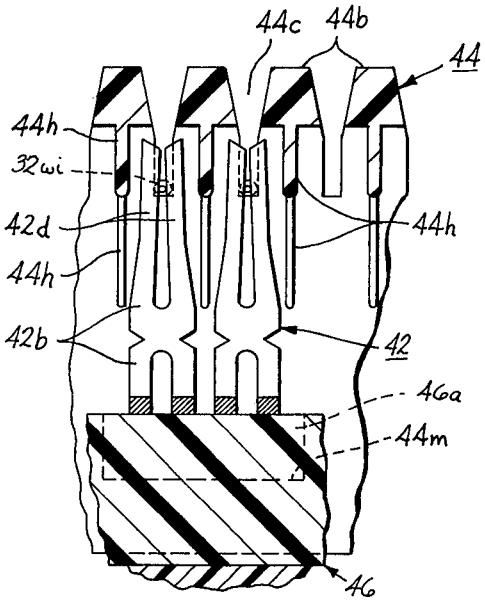
FIG. 5 is a cross-sectional view taken along the line 5—5 in FIG. 4.
Figure 6:
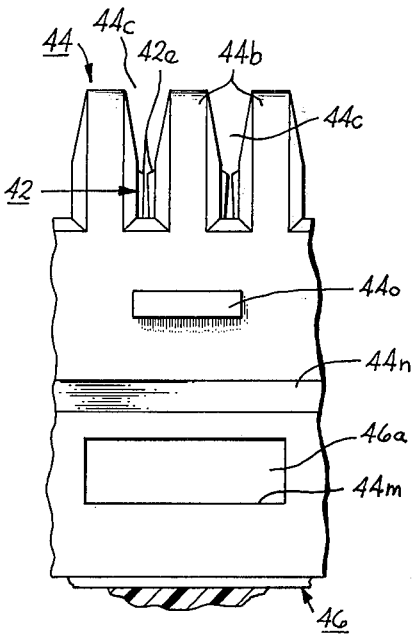
FIG. 6 is an elevational view, partially in cross section, as viewed in the direction of the arrows 6—6 in FIG. 4.

Referring to FIGS. 3, 4 and 5, in mounting the terminals 42 on the support block 44, the legs 42*b* of the terminals are positioned in passageways in communication with the wire-receiving slots 44*c* of the terminal support block and defined by the bight portion 44*a*, are resilient side legs 44*g* and the inner and outer sections 44*d* and 44*e* of the wire guide portions 44*b*. More specifically, each terminal leg 42*b*, with the exception of one leg at each end of the support block 44, as will subsequently be described, is received in an internal slot having outer end walls defined by the arcuate outer end sections 44*f* of the adjacent wire guide portions 44*b*, and sides defined by insulating ribs 44*h* (best shown in FIGS. 3 and 5) formed in the adjacent wire guide portions and having downwardly tapering portions integral with the adjacent resilient leg 44*g*. This locates the furcations 42*d* of the leg 42*b* adjacent-opposite sides of the wire-receiving slot 44*c* defined by the wire guide portions 44*b*, as illustrated in FIG. 5, for the reception of one of the insulated electrical conductor wires 28*wb* or 32*wi*. The outer insulation cutting edges 42*e* of each terminal leg 42*b* also are recessed (FIGS. 4, 5 and 6) with respect to the outer ends of the adjacent wire guide portions 44*b*, so that the leg is protected against bending or other physical damage from external sources, or from inadvertent electrical contact which could cause service interruption during use.

With further reference to FIGS. 3 and 4, the bight portion 42*a* of each of the terminals 42 seats against an inner surface of the bight portion 44*a* of the support block 44 in a slot defined by protecting insulating ribs 44*i* (FIG. 3) integral with the bight portion. The interval between the insulating ribs 44*h* and 44*i* of the wire guide portions 44*b* and the bight portion 44*a*, respectively, is such that the terminals 42 are retained in spaced insulated relationship with a slight freedom of lateral movement, so that the terminals are, in effect, self-centering with respect to their respective slots 44*c* (FIGS. 5 and 6) between the wire guide portions as the insulated electrical conductor wires 28*wb* or 32*wi* are pushed downward in the slots and into the legs 42*b* of the terminals. The terminals 42 are held in the support block 44 in their respective slots 44*c* by the retaining member 46, as shown in FIG. 4. The bight portion 44*a* of the support block 44 also includes a row of apertures 44*j* (FIGS. 3 and 4) extending therethrough from an elongated channel 44*k* in the support block and opening through an inner surface of the bight portion between respective ones of the insulating ribs 44*i*, to enable a test probe 48 to be engaged with the U-shaped terminals 42 for test purposes, as for example, after the electrical conductor wires 28*wb* of the local equipment cables 28 (FIGS. 4 and 14) have been connected to the terminal strip assembly 26.

As is best shown in FIGS. 1, 3 and 4, the resilient side legs 44*g* of the terminal support block 44, adjacent their free ends, include openings 44*m* in which latching projections 46*a* on the terminal retaining member 46 are received when the retaining member is pressed between the legs into engagement with the terminals and assembled to the block member. Thus, the terminals 42, terminal support block 44 and terminal retaining member 46 can be readily assembled together and the support block and retaining member can be readily dissassembled for replacement of the terminals. The resilient side legs 44*g* also include notches 44*n* in the outer surfaces thereof for receiving latching projections 50*a* on resilient side legs of a channel mounting member 50 (FIG. 4) for supporting the terminal assemblies 26 in end-to-end relationship in the equipment bay shown in FIG. 14. The outer surfaces of the resilient side legs 44*g* also are formed with latching protrusions 44*o* for mounting of the connector plug assembly 34 thereon, as shown in FIG. 25.

Figure 9:
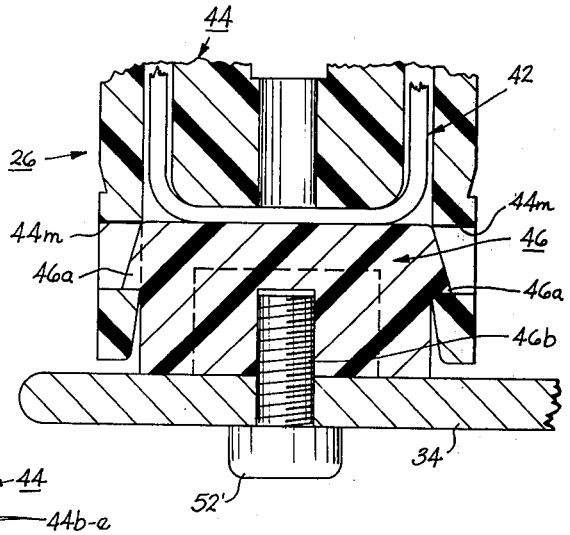
FIG. 9 is a cross-sectional view of a terminal strip assembly as shown in FIGS. 1 through 7, illustrating a second manner of mounting the terminal strip assembly.
Figure 8:
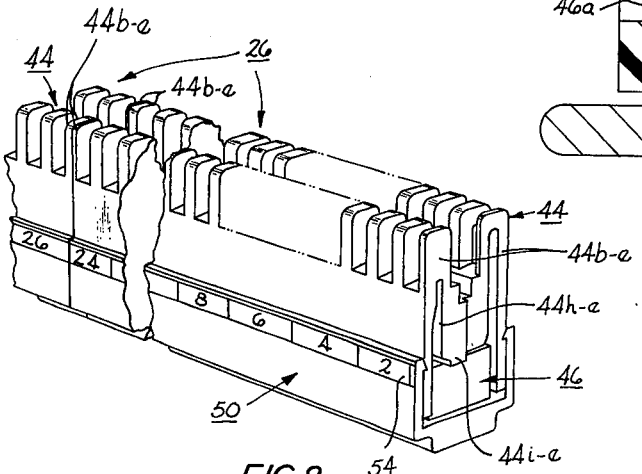
FIG. 8 is an isometric view of two of the terminal strip assemblies as shown in FIGS. 1 through 7, mounted in end-to-end relationship.

Referring to FIGS. 4 and 8, the elongated channel mounting member 50 may be formed of the same extruded plastic material ("Noryl 225") as noted above for the terminal support block 44 and retaining member 46. Each of the terminal assemblies 26 may be mounted in the channel mounting member 50 by pressing the terminal assembly downward between the resilient side legs of the mounting member until the latches 50*a* on the mounting member have seated in the notches 44*n* in the side legs 44*g* of the terminal support block 44. Similarly, one of the terminal strip assemblies 26 can be removed from the channel mounting member 50 for repair or replacement by flexing the legs of the channel member to an open position to release the assembly. In the alternative, the channel mounting member 50 may be left open-ended so that the terminal assemblies 26 can be slid into and out of the channel member longitudinally. In either case, the channel mounting member 50 is secured to the angle bar mounting members 36 of the equipment bay (FIG. 14) by suitable screws 52, as illustrated in FIG. 4. In the alternative, as is shown in FIG. 9, the terminal assemblies 26 may be directly secured to the mounting members 36 by self-tapping screws 52' threaded into cylindrical recesses 46*b* (only one shown) formed in the bottom of the retaining member 46, if so desired.

Figure 7:
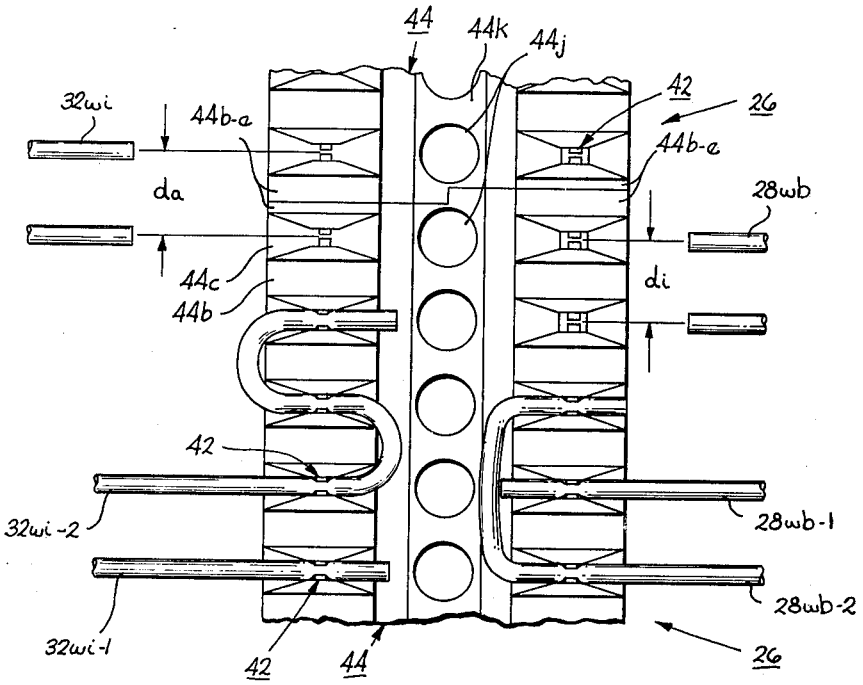
FIG. 7 is a partial view of two terminal strip assemblies as shown in FIG. 1 mounted in end-to-end relationship, as viewed in a direction indicated by the arrows 7—7 in FIG. 4.

As shown in FIGS. 7, 8 and 14, the terminal strip assemblies 26 can be readily mounted in end-to-end relationship in the channel mounting member 50 to provide a continuous line of the U-shaped terminals 42 of any desired length. For this purpose, in order that the positions of the terminals 42 will correspond to numbered designations (FIG. 8) provided on the channel mounting member 50, such as by strips of preprinted adhesive-backed tape 54, it is essential that the spacing "$d_a$" (FIG. 7) between the terminals in adjacent ones of the terminal strip assemblies 26 be identical to a spacing "$d_i$" (FIG. 7) between the terminals in one of the terminal strip assemblies. In the disclosed embodiment of the invention, in view of the closeness of the terminal spacings "$d_i$", opposite ends of each of the terminal support blocks 44 is of special construction for this purpose, as is best shown in FIGS. 1, 7 and 8. More specifically, the end wire guide portions 44*b–e* on the opposite ends of each terminal support block 44 are of reduced thicknesses, with the combined thicknesses of the end guide portions in each set of the guide portions being equal to the thickness of one of the intermediate guide portions. The end guide portions 44*b–e* also have planar offset surfaces which mate in interlocking relationship, as shown in FIG. 7, when the terminal assemblies 26 are placed in end-to-end relationship, with the mating reduced-thickness end portions cooperating to provide the same wire guiding and insulating functions provided by the intermediate wire guide portions. In this connection, as is best shown at the top of FIG. 1, a slot-defining insulating end rib 44*i–e* of the bight portion 44*a* of the terminal support block 44 is of half-width construction, with only its associated side of the terminal support block having a wire guide portion end insulating rib 44*h–e*. The other half of the end rib 44*i–e* and what would be its associated insulating rib 44*h–e* are eliminated to permit proper mating of two adjacent ones of the terminal strip assemblies 26 as above described.

An advantageous feature of the terminal strip assembly 26 is that, while it normally will be molded to include a fixed number of terminals 42, such as 24, by severing the terminal strip assembly (terminal support block 44 and retaining member 46) between two adjacent wire guide portions 44*b*, a terminal assembly having a desired lesser number of terminals can be provided. For example, in the disclosed embodiment of the invention, by severing the terminal strip assembly 26 in FIG. 1 so as to include at least one set of the apertures 44*m* in the side legs 44*g* of the terminal support block 44 and their associated latches 46*a* on the terminal retaining member 46, a terminal assembly containing a lesser number (e.g., four) of the terminals 42 can be readily be provided. Similarly, it is apparent that the channel mounting member 50 (FIG. 8) also can be cut to any length desired, in accordance with the number of terminals to be mounted therein.

Figure 10:
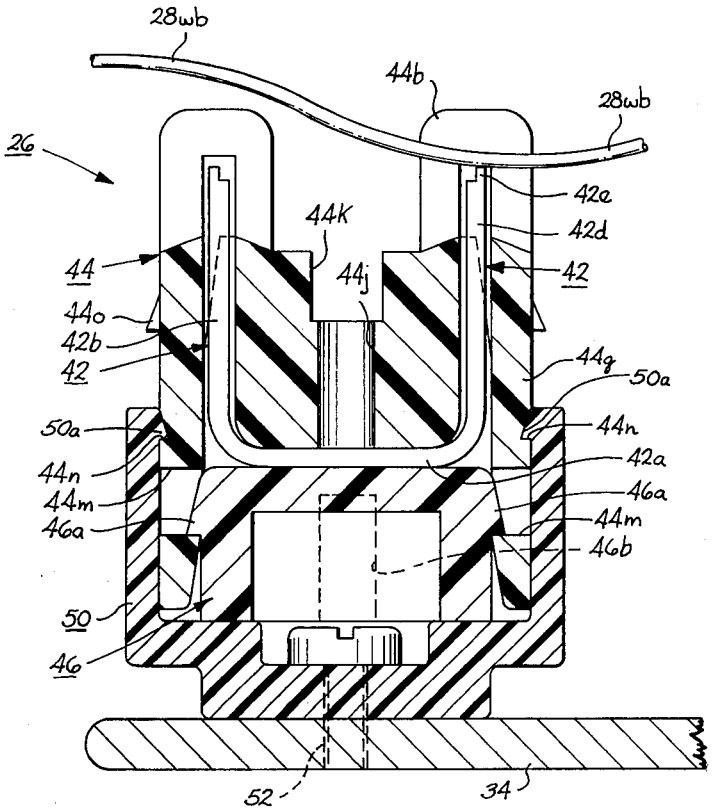
FIG. 10 is a cross-sectional view similar to FIG. 4, illustrating a first step in the connecting of an insulated electrical conductor wire to the terminal strip assembly shown in FIGS. 1–9.
Figure 11:
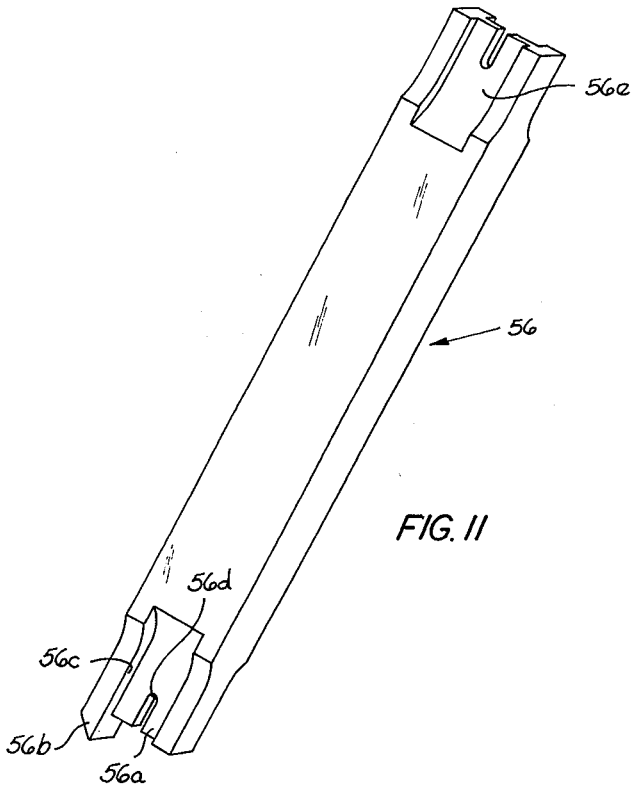
FIG. 11 is an isometric view of a wire seating-and-cutoff tool.
Figure 12:
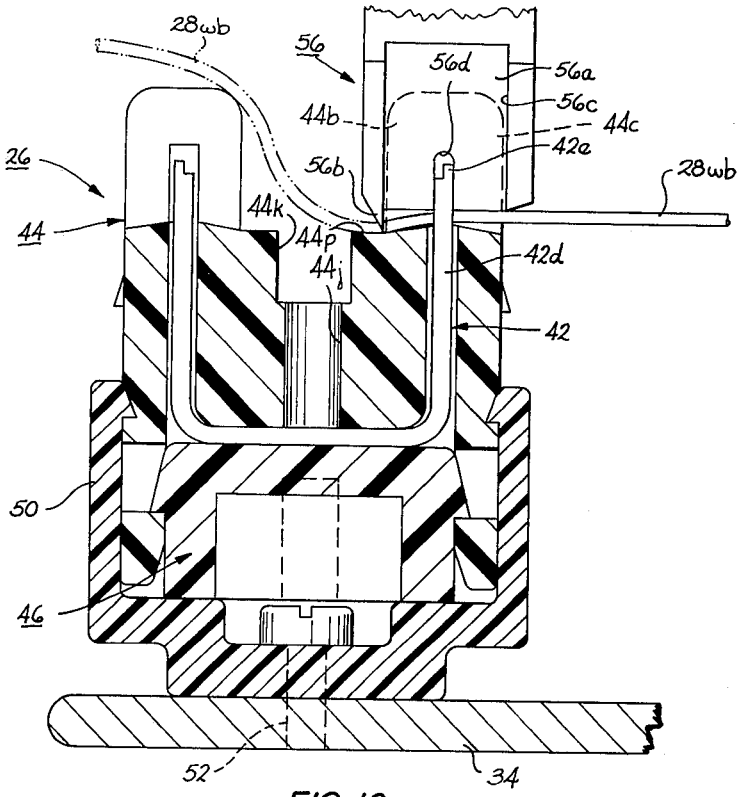
FIG. 12 is a cross-sectional view illustrating the seating and cutting of the insulated wire shown in FIG. 10, utilizing the tool shown in FIG. 11.

In wiring one of the terminal strip assemblies 26 in the factory, the insulated wires 28*wb* of the associated local equipment cable 28 (FIGS. 4 and 14) initially are positioned in the upper portions of their respective slots 44*c* between the wire guide portions 44*b*, with a short excess portion (several inches) of each wire extending past the guide portions to the left, as shown by one of the wires in FIG. 10. Each insulated wire 28*wb* then may be pushed downward in its respective slot and simultaneously cut to length as illustrated in FIG. 12, by the aid of a suitable tool 56, as shown in FIG. 11. For this purpose, the tool 56, which may be formed from a solid piece of tool steel by machining and heat treating, includes a wire seating portion 56*a* and a wire cutting portion 56*b* at one end thereof. During the seating of the insulated wire 28*wb* in the bottom of the slot 46*c*, guide grooves 56*c* on opposite sides of the tool 56, and a slot 56*d* of the tool seating portion 56*a*, receive the adjacent wire guide portions 44*b* of the terminal support block 44, and the furcations 42*d* of the terminal leg 42*b* in the slot 44*c*, respectively, to permit the seating of the wire to take place. As the wire 28*wb* is seated, the wire cutting portion 56*b* presses the wire against an upper shelf portion 44*p* of the terminal support block 44, with the shelf portion, which forms an aligned extension of the bottom of the adjacent slot 44*c*, acting as an anvil, to cut the wire to length. At the same time, the insulation of the wire 28*wb* is severed by the terminal furcations 42*d* to establish electrical contact with the wire, as above described. In the field, the insulated wires 32*wi* of the associated interbay cable 32 may be connected to the terminal strip assembly 26 in the same manner. In the alternative, the insulated wires 28*wb* or 32*wi* may be seated with a non-shearing seating portion 56*e* of the tool 56 and the excess portions of each of the insulated wires then trimmed off at the adjacent upper shelf portion 44*p* by scribing a suitable wire-cutting tool or knife (not shown) over the top of the shelf portion along the length thereof. If desired, a plurality of the wires 28*wb* or 32*wi* also may be seated (and cut to length) simultaneously by a suitable multi-wire engaging tool (not shown). Further, when a wiring change is required, since the wires 28*wb* and 32*wi* are on the same side of the terminal strip 26, the wires are readily accessible, and the involved wires 28*wb* or 32*wi* can readily be removed from the terminal furcations 42*d* of their respective terminal legs 42*b* and reinserted in terminal furcations of different ones of the terminals 42, as required.

FIG. 7 illustrates the flexibility of the terminal strip assembly 26 from the standpoint of connecting the insulated cable wires 28*wb* and 32*wi* to the terminals 42 of the terminal strip assemblies 26. Thus, a wire designated 28*wb*-1 and a wire designated 32*wi*-1 may be connected to respective terminals and simultaneously cut to length utilizing the tool 56 (FIG. 11) as described hereinabove. Another wire designated 28*wb*-2 may be connected to a pair of the terminals 42 on opposite sides of the terminal connected to the wire 28*wb*-1, as shown on the right-hand side of the figure. Similarly, a wire designated 32*wi*-2 may be connected to a series of three of the terminals 42 in a serpentine fashion, as shown on the left-hand side of the figure. It is apparent that other wire connecting arrangements may be utilized as desired.

Figure 13:
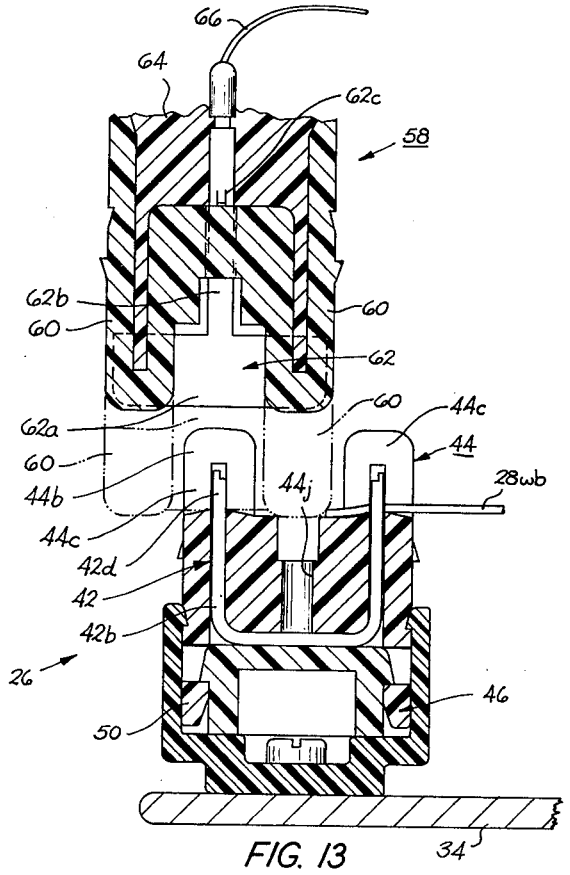
FIG. 13 is a cross-sectional view showing a test connector plug and its manner of use to test the terminal strip assembly after it has been wired as shown in FIG. 12.

Referring to FIG. 13, a connector plug 58 for testing one of the terminal strip assemblies 26 after it has been wired to the terminals of the equipment bay 30 as shown in FIG. 14, includes a terminal support block 60 which may be of the same type as the terminal support block 44 of the terminal strip assembly. The test connector plug 58, however, includes a row of essentially T-shaped (inverted, as viewed in FIG. 13) test terminals 62 (only one shown) having a cross-arm 62*a* and a projecting stem 62*b*. Opposite end portions of the terminal cross-arms 62*a* are received in slots corresponding to the wire-receiving slots 44*c* between the guide portions 44*b* of the terminal support block 44 of the terminal strip assembly 26. The stem 62*b* of each T-shaped terminal 62 extends through an aperture in the terminal support block 60 corresponding to one of the test apertures 44*j* in the terminal support block 44 of the terminal strip assembly 26, and includes a resilient tongue 62*c* for retaining the terminal in position in the support block 60 so that its interior can be filled with a suitable potting material 64. An outer end of the stem 62*b* of each T-shaped terminal 62 is connected to a lead wire 66 running to a test set, not shown. In testing the wired terminal strip assembly 26, the test connector plug 58 is inserted over the wire guide portions 44*b* on the unwired side of the assembly, as illustrated by broken lines in FIG. 13, so that central portions of the terminal cross-arms 62*a* are received between the furcations 42*d* of the terminal legs 42*b* associated with these wire guide portions, thereby connecting the wired side of the terminal strip assembly to the test set through the U-shaped terminals 42 of the terminal strip assembly for test purposes.

FIG. 25 discloses the use of one of the terminal strip assemblies 26 with the connector plug assembly 34, where it is desired to utilize the connectorized interbay cable 32' Which has been prewired to the connector plug assembly in the factory. As is shown in disassembled relationship in FIG. 15, the connector plug assembly 34 includes an elongated terminal support block 64, a row of essentially J-shaped terminals 66 mounted in the support block, a terminal retaining member 68 and a terminal cap 70 for the support block.

Referring to FIGS. 15–19, the terminal support block 64 includes a body portion 64*a* (FIGS. 15–17) and a row of projecting longitudinally spaced wire guide portions 64*b*. The wire guide portions 64*b*, which project horizontally from one side of the body portion 64*a*, as viewed in FIG. 17, define wire-receiving slots 64*c* therebetween and are of the same general construction as the wire guide portions 44*b* of the terminal support block 44 of the terminal strip assembly 26 (FIGS. 1–8 and 25). A first resilient side wall or leg 64*d* (FIGS. 15–18) of the terminal support block 64 projects in a vertical downward direction with respect to the body portion 64*a*, as viewed in FIG. 17, perpendicular to the direction of projection of the wire guide portions 64*b*. The leg 64*d* releasably retains the connector plug assembly 34 on the terminal strip assembly 26 by means of a pair of slots 64*e* (FIGS. 16–18) therein adjacent an outer free end thereof, and in which the latching projections 44*o* on one side of the terminal strip assembly's terminal support block 44 are receivable, as shown in FIG. 25. An undercut unlatching slot 64*f* (FIGS. 17 and 18) is formed in the first resilient leg 64*d* adjacent the center thereof, to permit a suitable tool (e.g., screw driver) to be inserted beneath the leg to pry it outward from the terminal strip assembly 26 to a released position.

The first resilient side leg 64*d* (FIGS. 15–18) of the terminal support block 64, and an inner leg 64*g* (FIGS. 15–17) which projects from the body portion 64*a* of the support block, define a channel therebetween which opens downward (as viewed in FIG. 17) through the lower side of the block and which is suitably recessed internally for receiving one of the rows of wire guide portions 44*b* of the terminal support block 44 of the terminal strip assembly 26 (FIG. 25) when the connector plug assembly 34 is mounted on the terminal strip assembly. The internally recessed portions of the terminal support block 64 include a plurality of projecting ribs 64*h* (FIGS. 17 and 18) receivable between respective ones of the wire guide portions 44*b* of the terminal support block 44 (FIG. 25) to locate and retain the connector plug assembly 34 in proper position thereon. As in the case of the terminal support block 44 of the terminal strip assembly 26, the terminal support block 64 of the connector plug assembly 34 has a row of test apertures 64*i* (FIGS. 15 and 19) formed therein through which the probe 48 may be inserted into engagement with the terminals 66 for test purposes, as shown in FIG. 25. Further, as in the case of the terminal strip assemblies 26, to produce proper spacing of the terminals 66 in adjacent ones of the connector plug assemblies 34 when the plug and terminal strip assemblies are mounted in end-to-end relationship, the opposite ends of the terminal support block 64 are formed with planar offset surfaces 64*j* (FIGS. 15–18), which mate in interlocking relationship in a manner similar to the surfaces of the end wire guide portions 44*b–e* of the terminal blocks 44 of the terminal strip assemblies 26, as shown in FIGS. 7 and 8.

The inner leg 64*g* (FIGS. 15–17) of the terminal support block 64 includes an offset portion 64*k* having a plurality of projecting locating lugs 64*m* which are received in the elongated slot 44*k* (FIG. 25) of the terminal support block 44 of the terminal strip assembly 26 when the connector plug assembly 34 is mounted thereon, as shown in FIG. 25. The offset portion 64*k* has a plurality of longitudinally extending slots 64*n* (FIGS. 16, 17 and 19) formed therein for receiving respective ones of a plurality of inner latching portions 68*a* (FIGS. 21–24) of the terminal retaining member 68. A second resilient side leg 64*o* (FIGS. 15–17) of the terminal support block 64, in which the aforementioned test apertures 64*i* are formed, projects horizontally outward with respect to the body portion 64*a*, as viewed in FIG. 17, in a reverse direction to the direction of projection of the wire guide portions 64*b*. The side leg 64*o* cooperates with the offset portion 64*k* and the slots 64*n* therein to releasably hold the terminal retaining member 68 in assembled relationship with the terminal support block 64, by means of a series of slots 64*p* in the side leg adjacent an outer free end thereof, and associated latching portions 68*b* (FIGS. 15, 22 and 23) on the retaining member. Thus, the terminal support block 64 and retaining member 68 can be readily assembled to hold the terminals 66 in the support block, and can be readily disassembled to permit replacement of the terminals. The retaining member 68, as in the case of the terminal support member 64, also is suitably recessed internally to receive the second row of wire guide portions 44*b* of the terminal support block 44 of the terminal strip assembly 26 (FIG. 25), and includes a plurality of internal projecting locating ribs 68*c* (FIGS. 21–24) and suitable reinforcing ribs 68*d*. The retaining member 68 also includes a projecting ridge 68*e* which may be utilized as a "handle" for manually removing the connector plug assembly 34 from the terminal strip assembly 26.

Figure 20:
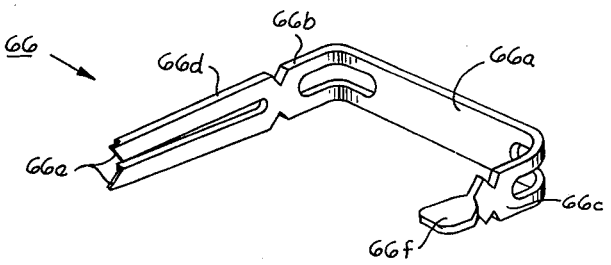
FIG. 20 is an isometric view of a terminal used in the connector plug assembly of FIG. 15.
Figure 21:
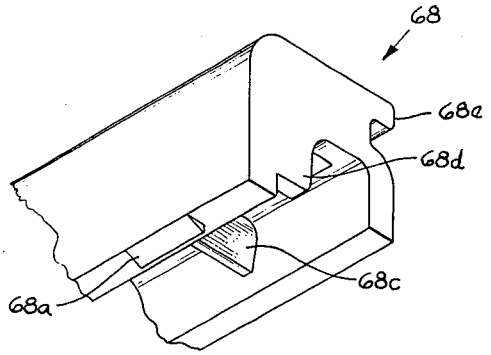
FIG. 21 is an isometric view of a terminal retaining member of the connector plug assembly shown in FIG. 15.
Figure 22:
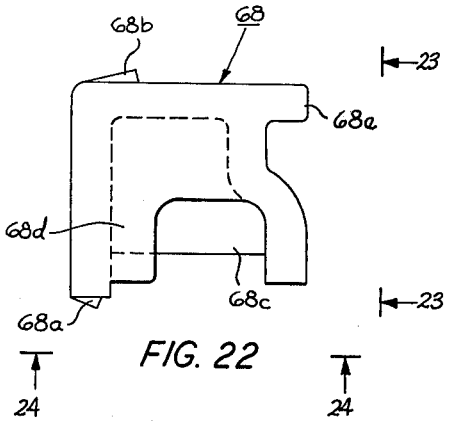
FIG. 22 is an end elevational view of the terminal retaining member shown in FIGS. 15 and 21.
Figure 23:
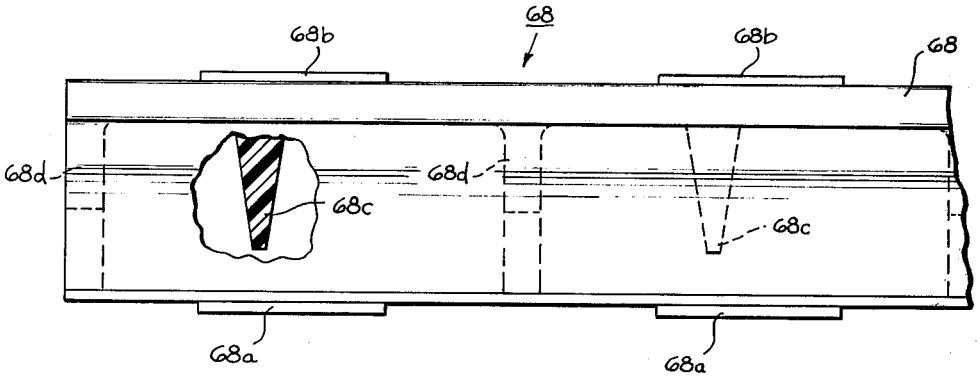
FIG. 23 is a view of the terminal retaining member shown in FIGS. 15, 21 and 22, as seen in the direction of the arrows 23—23 in FIG. 22.
Figure 24:
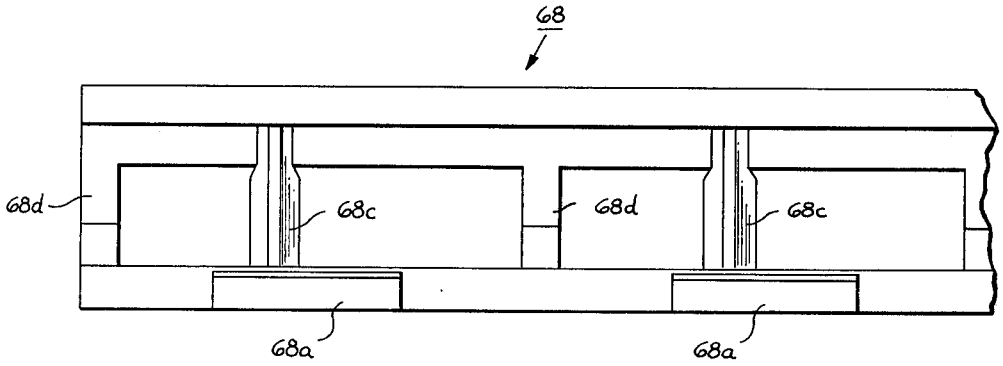
FIG. 24 is a view of the terminal retaining member shown in FIGS. 15, 21 and 22 as seen in the direction of the arrows 24—24 in FIG. 22.

As is best shown in FIG. 20, each of the J-shaped terminals 66 includes a bight portion 66*a* having a long leg 66*b* and a short leg 66*c* at its opposite ends. The long legs 66*b* of the J-shaped terminals 66 are received in respective slots in communication with the wire-receiving slots 64*c* of the terminal support block 64 and defined by the body portion 64*a*, the wire guide portions 64*b*, the second resilient leg 64*o* and a row of insulating ribs 64*q* (FIGS. 15–17 and 19) in the wire guide portions in the same manner that the legs 42*b* of the U-shaped terminals 42 are received in their respective elongated slots defined by the bight portion 44*a*, the wire guide portions 44*b*, the resilient legs 44*g* and the insulating ribs 44*h* (FIGS. 3, 4 and 5) of the terminal support block 44 of the terminal strip assembly 26. The long legs 66*b* of the J-shaped terminals 66 also are identical in construction to the legs of the U-shaped terminals 42 (shown in FIG. 2), with each leg having furcations 66*d* (FIG. 20) and insulation cutting edges 66*e* (FIG. 20) disposed on opposite sides of a respective one of the wire-receiving slots 64*c* (FIGS. 15–19) defined by the adjacent wire guide portions 64*b* for the establishing of electrical contact with one of the insulated wires 32*wi'* (FIG. 25) when the wire is pushed downward and seated in the slot. The bight portions 66*a* of the J-shaped terminals 66 also are received in slots defined by a row of insulating ribs 64*r* (best shown in FIGS. 15 and 16) of the terminal support member 64.

Referring to FIGS. 17, 18, 20, and 25, the short leg 66*c* (FIGS. 20 and 25) of each J-shaped terminal 66 extends through a respective one of a plurality of openings 64*s* (FIGS. 17, 18 and 25) in the inner leg 64*g* of the terminal support block 64 and into the channel defined by the inner leg and the first resilient side leg 64*d* of the terminal support block. The short terminal leg 66*c* also has a flattened spade-like portion 66*f* (FIGS. 20 and 25) at its free end, which may be formed by coining and, if so desired, plated with a long-wearing precious metal contact material (e.g., gold). The spade-like portion 66*f* is received between the furcations 42*d* of the adjacent terminal leg 42*b* to establish an electrical connection with its respective terminal 42 when the connector plug assembly 34 is mounted on the terminal strip assembly 26, as shown in FIG. 25.

Figure 26:
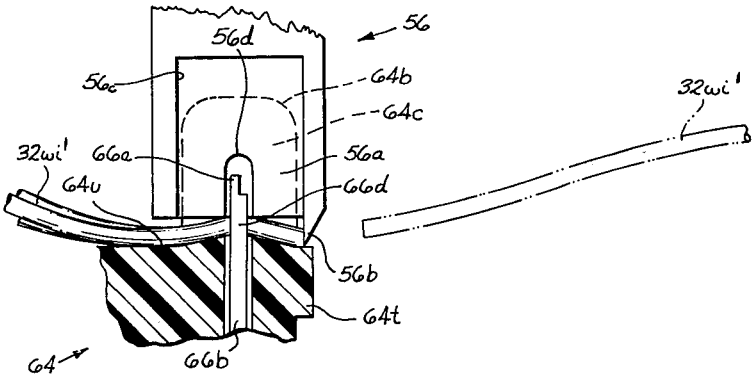
FIG. 26 is a partial cross-sectional view of the connector plug assembly of FIGS. 15–24, illustrating the seating of an insulated wire therein utilizing the tool shown in FIG. 11.

In utilizing the connector plug assembly 34, by way of illustration, the insulated wires 32*wi'* of the interbay cable 32' are prewired to the connector plug assembly at the manufacturing location by mounting the connector plug assembly in a suitable fixture (not shown) and then positioning each wire in its respective wire-receiving slot 64*c* with a short length of excess wire (several inches) extending beyond the wire guide portions 64*b*, as described hereinabove in connection with the seating of the wires 28*wb* in the terminal strip assembly 26, and as shown in FIG. 10. Each of the wires 32*wi'* *then may be pushed into and seated in its respective slot 64c,* as illustrated in FIG. 26, utilizing the tool 56 shown in FIG. 11, so as to make electrical contact with the furcations 66*d* of the long leg 66*b* of the J-shaped terminal 66 associated with the slot. At the same time, the excess portion of the wire 32*wi'*, as shown by broken lines in FIG. 26, is cut off adjacent the wire wide portion 64*b* by engaging the wire between the tool shearing blade 56*b* and one of a plurality of elongated anvil portions 64*t* (best shown in FIG. 15), which provide aligned extensions of the bottoms of the slots 64*c*. In the alternative, the wires 32*wi'* may be positioned in the wire-receiving slots 64*c* from the opposite direction (top of FIG. 25), in which case each wire is cut by engaging it between the tool shearing blade 56*b* and an anvil surface 64*u* (FIGS. 25 and 26) of the terminal support block 64.

The cap member 70 then is positioned over the wire guide portions 64*b* by camming a pair of resilient latching legs 70*a* (FIG. 15) thereof over the anvil portions 64*t* of the terminal support block 64, so that the legs extend through slots between the anvil portions with hook portions 70*b* of the legs in releasably latched engagement with the anvil portions to retain the cap member on the terminal support block, as shown in FIG. 25. Subsequently, in the field the connector plug assembly 34, with the cable wires 32*wi'* connected thereto, is inserted over the terminal strip assembly 26, which also has had a respective set of the insulated cable wires 28*wb* connected thereto as above described, to establish electrical connections between the wires of the connector plug assembly and the wires of the terminal strip assembly through the U-shaped terminals 42 and the J-shaped terminals 66, as shown in FIG. 25.

In summary, a new and improved electrical conductor terminating system has been provided in which electrical apparatus, such as the communications equipment bay 30 (FIG. 14), can be installed in the field utilizing the terminal strip assemblies 26 (FIGS. 1–8) and bulk cable, such as the interbay cable 32 (FIG. 4) on a single or paired wire quick-connect basis. In the alternative, the equipment bay 30 can be installed in the field utilizing the terminal strip assemblies 26 and connectorized cable, such as the interbay cable 32' (FIG. 25) which has been fabricated to the connector plug assembly 34 (FIGS. 15–24) in the factory, with the connector plug assembly subsequently being merely plugged to a respective one of the terminal strip assemblies in the field, as shown in FIG. 25. Various combinations of these two wiring methods in association with the equipment bay 30 also may readily be utilized, if so desired. In either instance, the wires 28*wb* of the equipment bay local cables 28 can readily be fabricated to the terminal strip assemblies 26 on a quick-connect basis as illustrated in FIGS. 10 and 12.

In addition to the versatility of the terminal strip assembly 26, wherein it can be readily utilized with either bulk-type or connectorized-type cable, the terminal strip assembly, consisting only of the molded terminal support block 44 and molded terminal retaining member 46, and the row of associated U-shaped quick-connect terminals 42, may be readily fabricated and assembled at low cost. The connector plug assembly 34, consisting of the molded terminal support block 64, terminal retaining member 68 and cap 70, and the row of associated J-shaped terminals 66, is advantageous for the same reason. Further, when the terminals 42 and 66 are mounted in their respective terminal support blocks 44 and 64, bending or other physical damage to the terminals from external sources, or inadvertent electrical contact with the terminals which could cause service interruption during use, is precluded as a result of the terminals being essentially encased in the support block and recessed with respect to the outer ends of the respective adjacent wire guide portions 44*b* and 66*b*. The terminal strip assembly 26 also is capable of accommodating high termination densities as a result of the close spacing of the terminals 42 which can be achieved in the terminal support block 42. In this connection, the terminal strip assemblies 26 may be mounted in end-to-end relationship in an elongated continuous row in the elongated channel 50, as shown in FIGS. 4 and 10, or individually by the screws 52' as shown in FIG. 9.

Referring to FIGS. 7 and 8, the mating offset planar surfaces of the end guide portions 44*b–e* of the terminal support block 44 permit this mounting of the terminal strip assemblies 26 with the terminals 42 in adjacent assemblies having a spacing "$d_a$" (FIG. 7) equal to the spacing "$d_i$" (FIG. 7) of the terminals within the terminal strip assemblies, with the spacings "$d_a$" and "$d_i$" corresponding to equally spaced terminal number designations on the numbered strips 54 (FIG. 8) on the channel mounting member 50. Similarly, the offset end surfaces 64*j* of the connector plug assemblies 34 also permit mounting thereof in the same relationship when the connector plug assemblies are mounted on the terminal strip assemblies 26.

The terminal strip assemblies 26 and the connector plug assemblies 34 also can be severed between two adjacent wire guide portions 44*b* or 64*b* into intermediate lengths as desired. Testing of the connection of the wires 28*wb* of the equipment bay cables 28 also may readily be accomplished using the test probe 48 in the test apertures 44*j* of the terminal strip assemblies 26 (FIG. 4) or the test apertures 64*i* of the connector plug assemblies 34 (FIG. 25). Further, removal and replacement of the wires 28*wb*, or 32*wi* or 32*wi'*, in the quick-connect terminals 42 and/or 66 of the terminal strip assemblies 26 and/or the connector plug assemblies 34 for repair or rewiring purposes, and/or replacement of the terminals 42 and 66, can readily be accomplished.

What is claimed is:

1. An electrically insulating terminal support block for holding electrical terminals having a bight portion and spaced legs projecting from opposite ends of the bight portion, which comprises:

a body portion;

electrical conductor guide portions projecting from one side of said body portion in a first direction and spaced apart to define electrical conductor-receiving slots therebetween;

first spaced insulating ribs in said guide portions defining slots for receiving respective ones of the legs of the terminals in insulated relationship;

second spaced insulating ribs on said body portion defining slots for receiving the bight portions of the terminals in insulated relationship;

a pair of resilient legs having outer free ends and each projecting outward with respect to said body portion in a different direction than the first direction in which said electrical conductor guide portions project from said body portion, said legs being spaced apart to permit the terminals to be inserted into and removed from said guide portions and said first and second ribs of the support block; and connecting means adjacent the outer free end of at least one of said resilient legs for assembling the support block to a member for retaining the terminals in the support block.

2. An electrically insulating terminal support block as recited in claim 1, in which:

opposite ends of the support block include offset planar surfaces for mating interlocking engagement with respective offset planar surfaces of second and third ones of the terminal support blocks when the three support blocks are mounted in end-to-end relationship.

3. An electrically insulating terminal support block as recited in claim 1, in which:

said electrical conductor guide portions project in the first direction from the one side of said body portion so as to define spaced parallel opposed sets of said guide portions; and said resilient legs project outward with respect to said body portion in a reverse direction in spaced parallel opposed relationship to one another.

4. An electrically insulating terminal support block as recited in claim 3, in which:

said electrical conductor guide portions at opposite ends of the support block in each of the sets of said guide portions are of reduced thicknesses with respect to said guide portions intermediate the ends of the support block, with the combined reduced thicknesses of each of the end guide portions in each set being equal to the thickness of the intermediate guide portions; and said reduced thickness guide portions defining offset planar surfaces for mating interlocking engagement with respective planar offset surfaces of second and third ones of the terminal support blocks when the three support blocks are mounted in end-to-end relationship.

5. An electrically insulating terminal support block as recited in claim 1, in which:

said resilient legs extend outward with respect to said body portion in directions perpendicular to one another.

6. An electrically insulating terminal support block as recited in claim 5, in which:

one of said resilient legs includes a set of probe-receiving apertures extending therethrough, with each aperture opening through said leg between a respective pair of said first spaced ribs which define the slots for receiving the legs of the terminals.

7. An electrically insulating terminal support block as recited in claim 1, in which:

said bight portion includes a set of probe-receiving apertures extending therethrough, with each aperture opening through said bight portion between a respective pair of said second spaced ribs which define the slots for receiving the bight portions of the terminals.

8. An electrically insulating terminal support block as recited in claim 1, which further comprises:

wire-cutting anvil surface portions defining aligned extensions of bottoms of the electrical conductor-receiving slots defined by said electrical conductor guide portions.

9. An electrically insulating terminal support block as recited in claim 1, in which:

said electrical conductor guide portions include inner and outer spaced parallel sections beteen which portions of the terminals are receivable and having first and second opposite ends, the first ends of the inner sections being connected to said body portion, the inner and outer sections being connected at their second ends by third sections of said guide portions, and said resilient legs being connected to and projecting from the first ends of the outer sections as extensions thereof.

10. An electrically insulating terminal support block as recited in claim 1, in which:

said electrical conductor guide portions have outer end sections defining outer end walls of the slots defined by said first spaced ribs.

11. An electrically insulating terminal support block for holding electrical terminals each having first and second legs interconnected by a bight portion, which comprises:

a bight portion;

sets of electrical conductor guide portions projecting in a first direction from the same side of said bight portion in spaced parallel opposed relationship, said electrical conductor guide portions being spaced apart to define electrical conductor-receiving slots therebetween;

a plurality of first spaced insulating ribs within said electrical conductor guide portions defining internal slots for receiving respective ones of the first and second legs of the terminals in insulated relationship;

a plurality of second spaced insulating ribs on said bight portion defining slots for receiving the bight portions of the terminals in insulated relationship;

said electrical conductor guide portions at opposite ends of the support block being of respective reduced thicknesses with respect to said electrical conductor guide portions intermediate the ends of the support block, with the combined reduced thicknesses of each of the end guide portions in each set being equal to the thickness of each of the intermediate guide portions;

said reduced-thickness guide portions defining offset planar surfaces for mating interlocking engagement with respective planar offset surfaces of second and third ones of the terminal support blocks when the three support blocks are mounted in end-to-end relationship;

said electrical conductor guide portions including inner and outer spaced parallel sections between which portions of the terminals are receivable and having first and second opposite ends, the first ends of the inner sections being connected to said bight portion and the inner and outer sections being connected at their second ends by third sections of said guide portions;

a pair of resilient legs having outer free ends and projecting from the first ends of the outer sections of said electrical conductor guide portions in a reverse direction with respect to the first direction in which said electrical conductor guide portions project from said bight portion, said legs projecting outward with respect to said bight portion in spaced parallel opposed relationship; and latching portions adjacent the outer free ends of said resilient legs for assembling the support block to a member for retaining the terminals in the support block.

12. An electrically insulating terminal support block for holding electrical terminals each having first and second legs interconnected by a bight portion, which comprises:

a body portion;

a set of spaced electrical conductor guide portions projecting from said body portion;

a plurality of first spaced insulating ribs within said electrical conductor guide portions defining internal first slots for receiving the first legs of the electrical terminals in insulated relationship;

spaced first and second legs projecting from said body portion and defining a channel in the support block which opens outward at one side of the support block, said first leg being resilient and including a latching portion adjacent an outer end thereof;

a plurality of spaced second insulating ribs on said second channel-defining leg and defining second slots for receiving the bight portions of the terminals in insulated relationship;

said second channel-defining leg including openings for receiving the second legs of the electrical terminals, the openings connecting adjacent ends of the second slots defined by said rib means, with the open channel defined by said first and second legs of the support block;

offset planar surfaces at opposite ends of the terminal support block for mating interlocking engagement with respective offset planar surfaces of second and third ones of the terminal support blocks when the three support blocks are mounted in end-to-end relationship; and a resilient third leg projecting outward with respect to said body portion substantially perpendicular with respect to said first and second channel-defining legs and including a latching portion adjacent an outer end thereof.

13. A terminal assembly, which comprises:

an electrically insulating terminal support block including a body portion, sets of spaced electrical conductor guide portions projecting in a first direction from one side of the body portion in spaced parallel opposed relationship, and spaced parallel side legs projecting in a reverse direction outward with respect to the body portion;

a set of spaced electrical terminals mounted on said support block, each of said terminals including spaced interconnected legs extending in substantially parallel opposed relationship and a portion of each terminal leg being located in a slot defined by respective adjacent ones of the spaced projecting electrical conductor guide portions for engagement by an electrical conductor when the conductor is inserted in the slot defined by the adjacent ones of the spaced guide portions; and a retaining member mounted between the projecting parallel opposed side legs of said support block to retain said terminals in said support block.

14. A terminal assembly as recited in claim 13, in which:

the side legs of said support block are resilient in nature; and the side legs of said support block and said retaining member include interengageable latching portions for mounting said retaining member between the side legs.

15. A terminal assembly as recited in claim 14, in which:

the electrical conductor guide portions include inner and outer spaced parallel sections having portions of the terminals received therebetween and having first and second opposite ends, the first ends of the inner sections being connected to the body portion, the inner and outer sections being connected at their second ends by third sections of the guide portions, and the side legs of said support block being connected to and projecting from the first ends of the outer sections as extensions thereof.

16. A terminal assembly as recited in claim 13, in which:

said electrical conductor guide portions at opposite ends of the support block are of respective reduced thicknesses with respect to said electrical conductor guide portions intermediate the ends of the support block, with the combined reduced thicknesses of each of the end guide portions in each set being equal to the thickness of each of the intermediate guide portions; and said reduced-thickness guide portions defining offset planar surfaces for mating interlocking engagement with respective planar offset surfaces of second and third ones of the terminal support blocks when the three support blocks are mounted in end-to-end relationship.

17. A connector plug assembly, which comprises:

an electrically insulating terminal support block including a body portion, opposed leg portions projecting in a first direction from the body portion to define a channel portion which opens outward at a first side of said support block, and a set of spaced electrical conductor guide portions projecting outward from the body portion at a second side of said support block in a second direction perpendicular to the first direction in which the opposed channel-defining legs project from the body portion; and a set of spaced essentially J-shaped electrical terminals mounted on the body portion of said support block, each of said electrical terminals having first and second legs interconnected by a bight portion;

the first leg of each of said terminals extending in part into a space between respective adjacent ones of said spaced electrical conductor guide portions for engagement by an electrical conductor when the conductor is inserted in the space between said guide portions; and the second leg of each of said terminals being shorter than the first leg of said terminal and having a portion projecting through one of the opposed leg portions of said support block into the open channel portion of said support block.

18. A connector plug assembly as recited in claim 17, which further comprises:

wire cutting anvil portions on said support block extending adjacent said electrical conductor guide portions;

a cap member positionable over said electrical conductor guide portions; and interengageable means on said anvil portions and said cap member for releasably mounting said cap member on said electrical conductor guide portions.

19. A connector plug assembly, which comprises:

an electrically insulating terminal support block including a body portion, a channel portion adjacent the body portion which opens outward at a first side of said support block, and a set of spaced electrical conductor guide portions projecting outward from the body portion at a second side of said support block;

a set of spaced essentially J-shaped electrical terminals mounted on the body portion of said support block, each of said electrical terminals having first and second legs interconnected by a bight portion;

the first leg of each of said terminals extending in part into a space between respective adjacent ones of said spaced electrical conductor guide portions for engagement by an electrical conductor when the conductor is inserted in the space between said guide portions; and the second leg of each of said terminals having a portion projecting into the open channel portion of said support block; and a retaining member releasably mounted on said support block in engagement with the bight portions of said electrical terminals for retaining said terminals on said support block.

20. A connector plug assembly as recited in claim 19, in which:

the open channel portion of said support block is defined by spaced first and second parallel legs projecting from the body portion of said support block;

the first leg of said support block is resilient and includes latching means for mounting the connector plug assembly on an associated terminal assembly; and the second leg of each of said terminals extends through an opening in the second leg of said support block into the open channel portion.

21. A connector plug assembly as recited in claim 20, in which:

the second leg of said terminal support block includes a latching portion and said terminal support block includes a resilient third leg which extends substantially perpendicular to the second leg and which includes a latching portion cooperable with the latching portion of the second leg for releasably holding the terminal retaining member in assembled relationship with said terminal support block.

22. An electrical conductor terminating system, which comprises:

a first elongated electrically insulating terminal support block having an essentially M-shaped configuration and including a transverse bight portion, transversely spaced first and second rows of longitudinally spaced electrical conductor guide portions projecting in a first direction from one side of the bight portion, and transversely spaced resilient side legs projecting in a reverse direction outward with respect to an opposite side of the bight portion;

a row of longitudinally spaced removable U-shaped electrical conductor terminals mounted on said first support block, each of said U-shaped terminals including first and second legs extending in part within a pair of respective adjacent ones of the spaced projecting first and second electrical conductor guide portions, with each of the legs having an outer end recessed with respect to outer ends of the conductor guide portions;

each of the legs of said U-shaped terminals being bifurcated adjacent its outer end with furcations of the legs located in part in a space between the spaced adjacent ones of the electrical conductor guide portions;

a plurality of first electrical conductors disposed in respective ones of the spaces between the first electrical conductor guide portions and received between the furcations of the first terminal legs;

a first retaining member releasably mounted between the resilient transversely spaced side legs of said first support block to retain said U-shaped terminals on said first support block;

a second elongated electrically insulating terminal support block having a row of longitudinally spaced electrical conductor guide portions and having spaced legs defining an elongated channel therein, said second support block being releasably mounted on said first support block with the second electrical conductor guide portions of said first support block received in the channel in said second support block;

a row of longitudinally spaced removable essentially J-shaped electrical conductor terminals mounted on said second support block and each having first and second prjecting legs;

the first leg of each of said J-shaped electrical terminals extending in part within a pair of respective adjacent ones of the spaced projecting electrical conductor guide portions of said second support block and having an outer end recessed with respect to outer ends of the conductor guide portions, the first leg also being bifurcated adjacent its outer end with furcations of the leg located in part in a space between the spaced adjacent ones of the conductor guide portions;

a plurality of second insulated electrical conductors disposed in respective ones of the spaces between the electrical conductor guide portions of said second support block and received between the furcations of the terminal legs located therein;

the second leg of each of said J-shaped terminals being shorter than the first leg on said terminal and projecting through one of the legs of said second support block into the channel in said second support block, with the second leg of the J-shaped terminal being received between the furcations of a respective one of the second terminal legs of said U-shaped terminals in said first support block; and a second retaining member releasably mounted on said second support block in engagement with bight portions of said J-shaped terminals to retain said terminals on said second support block, said second retaining member including a portion extending over the second row of electrical conductor guide portions of said first support block.

23. An electrically insulating terminal support block for holding electrical terminals having a bight portion and spaced legs projecting from opposite ends of the bight portion, which comprises:

a body portion;

electrical conductor guide portions projecting from one side of said body portion in a first direction and spaced apart to define electrical conductor-receiving slots therebetween;

a pair of resilient legs having outer free ends and each projecting outward with respect to said body portion in a different direction than the first direction in which said electrical conductor guide portions project from said body portion;

electrically insulating portions, including portions of said body portion and portions of at least one of said resilient legs, defining terminal leg-receiving slots for receiving respective ones of the legs of the terminals, the terminal leg-receiving slots being in communication with the electrical conductor-receiving slots defined by said electrical conductor guide portions and said resilient legs being spaced apart to permit the terminals to be inserted into and removed from the terminal leg-receiving slots; and connecting means adjacent the outer free end of at least one of said resilient legs for assembling the support block to a member for retaining the terminals in the support block.

* * * * *

UNITED STATES PATENT OFFICE

CERTIFICATE OF CORRECTION

PATENT NO. : 4,066,317

DATED : Jan. 3, 1978

INVENTOR(S) : Herbert H. Bierenfeld-Charles McGonigal-Chauncey M. Horton, Jr.-John A. Kelsey It is certified that error appears in the above-identified patent and that said Letters Patent are hereby corrected as shown below:

In the specification, Column 7, line 21, "are" should read --the--; and line 33, "adjacent-opposite" should read --adjacent opposite--. Column 13, lines 22 and 23, "then may be pushed into and seated in its respective slot" should not be italicized; and line 29, "wide" should read --guide--. Column 16, line 20, "beteen" should read --between--. Column 20, line 40, "prjecting" should read --projecting--.

Signed and Sealed this

*Ninth* Day of *May 1978*

[SEAL]

*Attest:*

RUTH C. MASON
*Attesting Officer*

LUTRELLE F. PARKER
*Acting Commissioner of Patents and Trademarks*